US005603506A

United States Patent [19]

Pickup

[11] Patent Number: 5,603,506

[45] Date of Patent: Feb. 18, 1997

[54] REMOVABLE AND RETRACTABLE POINT SYSTEM FOR A DART

[76] Inventor: Jeffrey Pickup, 145 Rembrandt Place,, London, Ontario, Canada, N6C 5G9

[21] Appl. No.: 631,182

[22] Filed: Apr. 12, 1996

[51] Int. Cl.[6] ..... A63B 65/02

[52] U.S. Cl. ..... 473/585

[58] Field of Search ..... 273/416, 419, 273/420, 423

[56] References Cited

U.S. PATENT DOCUMENTS

| | | | |
|---|---|---|---|
| 3,976,298 | 8/1976 | Hinchman | 273/420 |
| 4,181,303 | 1/1980 | Sjogren | 273/420 |
| 4,230,322 | 10/1980 | Bottelsen | 273/420 |
| 4,697,815 | 10/1987 | McKenna | 273/420 |
| 5,009,433 | 4/1991 | Reid | 273/419 |
| 5,248,151 | 9/1993 | Pickup | 273/420 |
| 5,505,460 | 4/1996 | Wolfenden et al. | 273/420 |

FOREIGN PATENT DOCUMENTS

| | | | |
|---|---|---|---|
| 2228211 | 8/1990 | United Kingdom | 273/419 |

*Primary Examiner*—Paul E. Shapiro

[57] ABSTRACT

A novel dart is equipped with a dart point contraction system which allows the dart point to contract into the body or barrel of the dart as when the dart point impacts wire, or staples and the like which surmount boundaries of denominated regions of a dart board. The dart body defines a cylindrical cavity into which the downstream end of the dart point can reciprocatingly travel since it also is cylindrical and comes to rest against the dart body at the end of its travel. It is as a result of kinetic energy of flight that even though the dart point may have impacted a boundary wire or even a denominated region of the dart board, dart "bounce-out" is inhibited by the momentum of dart point upstream end travelling into the dart body housing. Because of a tapered furrel in the front portion of the dart body, the whole dart point system furrel and point may be simply removed as by (strongly) pulling or to be replaced most conveniently with a simple extraction tool.

12 Claims, 2 Drawing Sheets

REMOVABLE AND RETRACTABLE POINT SYSTEM FOR A DART

This invention relates to darts, as used in a game of skill, now universally known and played around the world as both a leisure and as a competitive sport or game.

BACKGROUND TO THE INVENTION

A prior art device is disclosed in a U.S.A. patent issued 6 Oct. 1987 as U.S. Pat. No. 4,697,815 to one McKenna for a DART. That particular patent describes a tapered point which is seized, in its forward and extended position, by a collar which has a thread that matingly threads into a threaded cylindrical bore defined by the dart body. The machining of the threaded collar and female threaded mating bore in the body is expensive; furthermore, the construction of a fully tapered point, with the butt end, is also expensive. Another dart with retractable point is disclosed by Bottlesen in his U.S. Pat. No. 4,230,322 issued 28 Oct. 1980.

In my U.S.A. patent for a RETRACTABLE POINT SYSTEM FOR A DART, issued 28 Sep. 1993 as U.S. Pat. No. 5,248,151, I disclosed a dart point system that eliminated threads and substituted therefore, a split sleeve in a frictional engagement with a stepped bore defined by the dart body. This allowed the dart point to retract into the dart body housing on impact, particularly if the dart point struck a wire overlaying denominated boundaries on the dart board. The retractable point system of that dart was removable from the dart body; conveniently with the use of a tool, as disclosed and depicted in FIGS. 5 and 6 of that patent.

It is an object of the present invention to enhance and improve a dart structure where not only is the point system for the dart retractable but also more simply removable from the dart body preferably with an extraction tool so that the dart point can be replaced or otherwise conveniently serviced using only minimum effort or skill.

SUMMARY OF THE INVENTION

The invention achieves not only retraction of the dart point on impact whether the point strikes wires or staples fastened into a dart board, or into the dart board itself, while also allowing simple pulling of the dart from the dart board to reset the dart point to its most forward position.

A simple novel extractor can be used to remove the point assembly, according to this invention, from the actual dart body so the dart point with furrel can be serviced or replaced particularly if the point has been damaged during play.

The invention therefore achieves a dart comprising a cylindrical-like body defining, at one end, an aperture communicating with a tapered cylindrical bore, the other end of the body carrying a flight, a tapered furrel adapted to extend through the aperture and to matingly engage with the tapered bore, the furrel defining a dart point accommodating axially oriented aperture therethrough, a dart point having a tapered shaft portion that terminates as a forward point, the tapered shaft at its opposite end stepping through an annular shoulder into a cylindrical segment, the furrel defining an inner annular race accommodating a resilient O-ring therein whose inner diameter frictionally engages the outer diameter of the cylindrical segment thereby holding the dart point firmly in the body but allowing the dart point to travel to and fro within the bore.

The invention also achieves the facility to have the dart body freely rotate relative to the dart point, reducing any flight obstruction to the next thrown dart by allowing the cylindrical segment of the dart point to rotate because its annular shoulder, on impact of the dart point into the board or an obstruction, is dis-engaged from friction engagement and thus, inwardly clears contact with the resilient O-ring thus, removing any frictional engagement while the dart board is fixedly engaged in the board thereby allowing free rotation of the body and its flight.

The invention therefore achieves a dart comprising a cylindrical-like body defining, at one end, an aperture communicating into a tapered portion of an internal body bore, the other end of the body carrying a flight; a tapered furrel adapted to extend into the aperture and to matingly engage with the tapered portion, the furrel defining a dart point accommodating axially oriented internal furrel bore therethrough, the furrel defining an inner annular race communicating with the internal furrel bore; a dart point having a tapered shaft portion that terminates as a forward point, the tapered shaft at its opposite end stepping through an annular shoulder into a cylindrical segment defining an outer cylindrical diameter which extends to terminate at a disc plate with integral rear face whose diameter is larger than the outer cylindrical diameter; and, the furrel also defines an inner annular race accommodating a resilient O-ring therein whose inner diameter is less than the cylindrical diameter to frictionally engage the outer cylindrical diameter thereby holding the dart point firmly in the body but allowing the dart point to travel to and fro within the internal body bore.

Particularly, the internal body bore defines a bore backwall and the resilient O-ring is positioned at a dimension D2 from the backwall while a length of the cylindrical shaft portion is approximately dimension D which is greater than that of D2.

Additionally, and in combination with the aforesaid dart, there is a tool for removing the dart point form the dart body including a first block defining a threaded aperture whose inner diameter is greater than the outer cylindrical diameter; a second block defining a stepped bore, with its minor bore being sized slightly larger than the outer cylindrical diameter, the major bore carrying an annular sleeve with an inner diameter sized larger than the cylindrical diameter, and an outer threaded diameter sized to threadingly engage and mate into the threaded diameter of the first member and to travel therein; and, a second bore defined by the second block communicating with the minor bore and carrying therein means for extending into the minor bore so as to urge against the dart point when the same extends therethrough.

BRIEF DESCRIPTION OF THE DRAWINGS

The invention will now be described by way of example and with reference to the accompanying drawings in which:

Referring to FIG. 1, the dart 10, according to the invention, consists of a cylindrical-like body or barrel 11; which, in this figure, is shown as truncated oblate ellipsoid 11, which has a forward aperture 12 carrying therein a novel ellipsoid collar or furrel 23 through which extends a retractable dart point 14 having a forward or upstream point 15 for penetration into a dart board or the like. The body 11 extends rearwardly, and can be slightly tapering, into a shaft or stem 16 carrying the flights 17.

Referring to FIG. 3, the dart point 14 has a tapered or conical shaft portion 19, that at its upstream end, tapers into a penetrating point or tip 15. The downstream end of the conical taper 19 terminates at an annular shoulder 21 but extends downstream as a cylindrical shaft portion 20 that is dimensioned a distance, D, which represents approximately 20% of the total length of the dart point 14 and terminates at a back disc plate 22.

Figure 2:
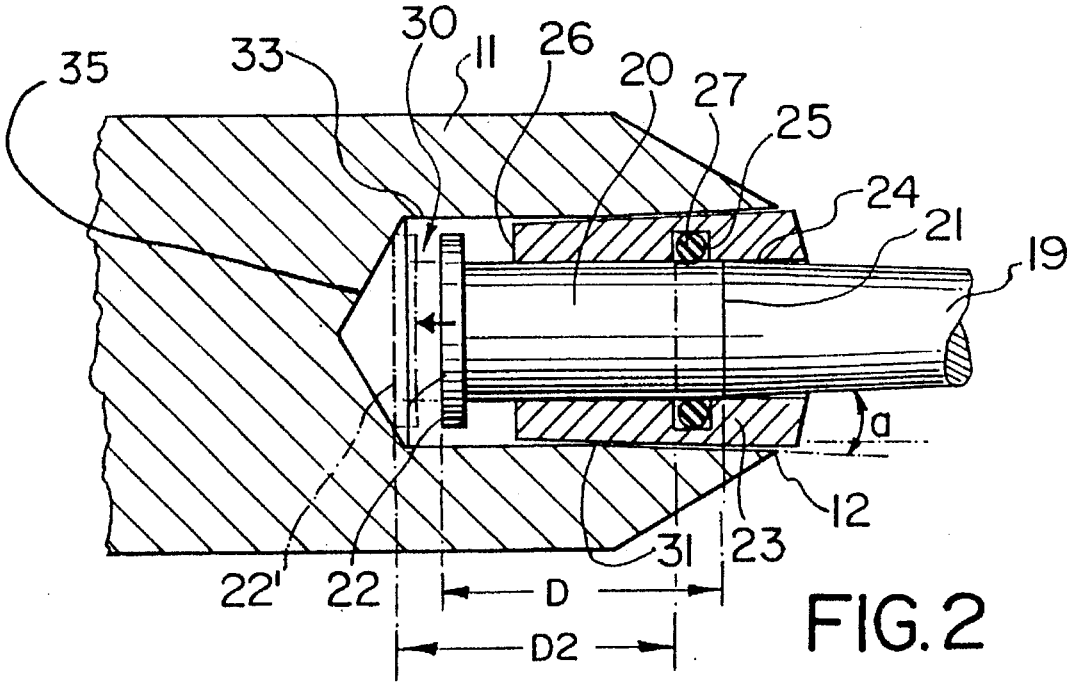
FIG. 2 is of a partial sectional view of the point in the tapered-cylindrical bore defined by the dart body and showing frictional interface between the novel annulus or a resilient O-ring carried by the furrel and engaging the annular perimeter of a portion of the cylindrical shaft of the dart point, whilst the point is fully extended.
Figure 3:
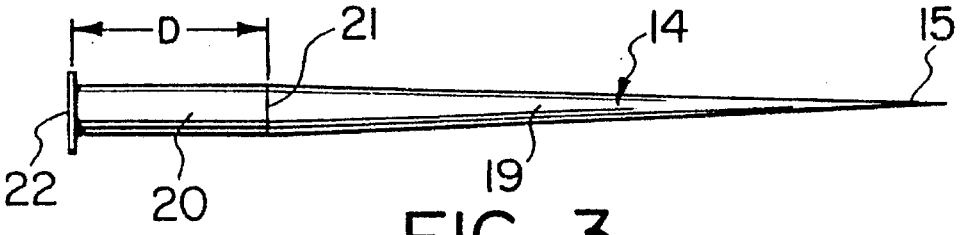
FIG. 3 is a side view, exaggerated, of the dart point.

Referring to the partial cross-sectional view of FIG. 2, the dart body 11 defines a aperture 12 which is the outer limit of a tapered cylindrical bore 30 having a forward tapering portion 31 transforming into a smaller cylindrical portion 33 that terminates at a back wall, which is shown as conical surface 35, since the bore 30 is formed by drilling. A collar, bushing, sleeve or furrel 23 has an outer tapered diameter sized to mate and to frictionally fit into the tapered portion 31 of the bore 30. The furrel 23 defines a cylindrical channel 24 therethrough, to accommodate reciprocal movement of the cylindrical shaft portion 30 of the dart point 14 therein, and the cylindrical channel 24 communicates with an inner annular race 25 which houses a resilient or elastomeric O-ring 27 whose inner diameter is fractionally smaller than the outer diameter of the cylindrical shaft portion 30 by approximately 1 mm or the like. When the furrel 23 is fitted into the tapered portion 31 of the bore 30, the elastomeric O-ring 27 is positioned at a dimension D2 which is slightly less than the dimension D of the cylindrical portion 20 of the dart point 14, thus, to frictionally engage an annular segment of the outer perimeter of the cylindrical shaft portion 20 of the dart point 14 (near the shoulder 21) but only when the dart point 14 is positioned in its most forward extended position so that an integral back disk plate 25, which is the upstream termination of the dart shaft 20 can abut against an annular rear face 26 of the furrel 24. This structure provides a stop mechanism for the most forward position of the dart point and in cooperation with the resiliency of the O-ring 27 on the cylindrical shaft portion 20 positionally stabilizes the dart point 14 in this most outwardly extended position, relative to the dart body 11.

When the dart strikes the board or a wire dividing various denominated areas of play on the dart board, the dart point travels rearwardly, in the direction of the arrow shown in FIG. 2, to abut against the rear wall 35 of the tapered cylindrical bore 30, as shown in phantom. The position of the elastomeric O-ring 27 is located at a distance D2 from the back face 35 of the bore 30 and is less than the dimension D being the length of the cylindrical shaft portion 20 by approximately 1 mm or 2 mm or the like. Thus, when the dart point back disk plate 22 abuts, shown in phantom in FIG. 2, the bore back wall 35 of the tapered portion 19 of the dart point is free of frictional engagement with the O-ring 27, allowing free rotation of the dart body 11 relative to the point 14 while at the same time, the cylindrical inner channel 24 of the furrel 23 maintains a stabilizing influence by loosely bearing on the cylindrical shaft portion 20. During this procedure, of impacting, the momentum of the dart body 11 carries the dart body 11 forward relative to the dart point 14, applying a constant pressure to the dart tip 15 helping its engagement or sliding over one of the dart board wires for penetration into the dart board then, on impact of the disk 22 onto the back face 35 a "hammer action" occurs to drive the point tip 15 into the board.

Bounce-out is thus minimized.

Figure 1:
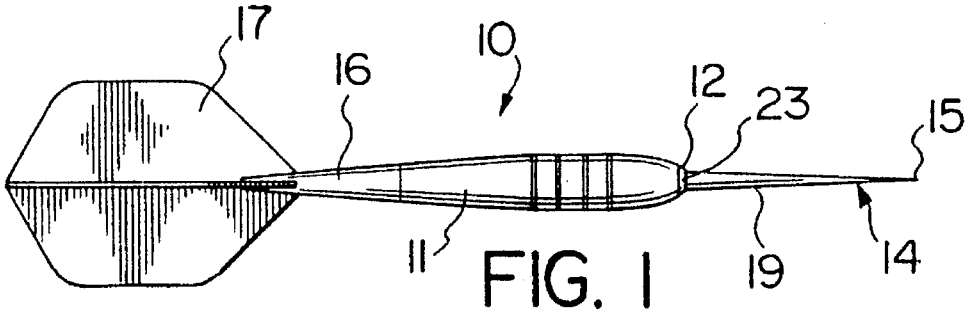
FIG. 1 is a side elevational view of the dart.

At the same time, by simple pulling in the direction opposite to the arrow in FIG. 1, the dart point is reset to its most forward position with the dart point plate 22 abutting the annular rear face 26 of the furrel 23 while held there by the frictional engagement of the elastomeric ring 27. By further stronger pulling and by virtue of the back disk plate 22, being integral with the shaft portion 20, of the dart 14, the disk plate 22, acts as a hammer against the annular rear face 26, of the furrel 23 dis-engaging it along with the dart point 14, from the body 11. The dart point 14, can be replaced and re-inserted with the furrel 23 back into the tapered bore portion 12.

With significant use of the aforesaid dart, and because it is preferred that the angles of the inner and outer tapers respectively, 31 and 29 be at the same angle "a"; this produces "a locking" taper that is sometimes difficult to unseat so as to remove the dart point 14 with furrel 23 from the body 11, as just aforesaid described; a dart point extraction tool 50 may be used.

Figure 4:
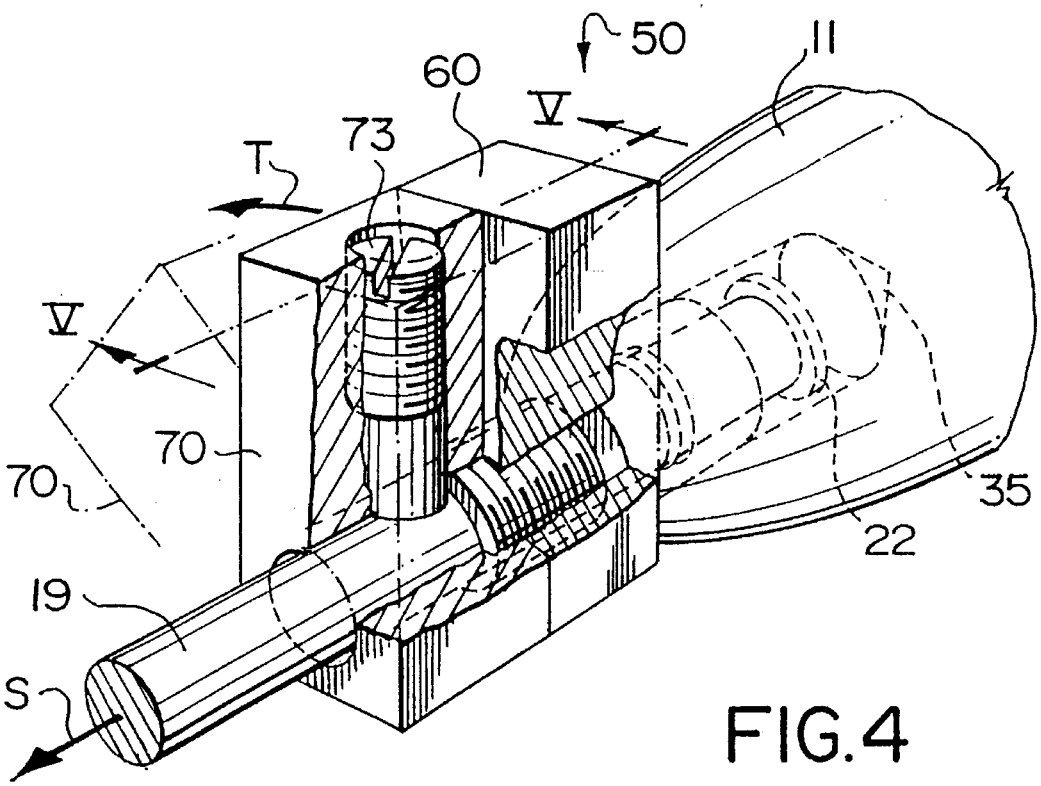
FIG. 4 is a perspective view of a dart point extraction tool.
Figure 5:
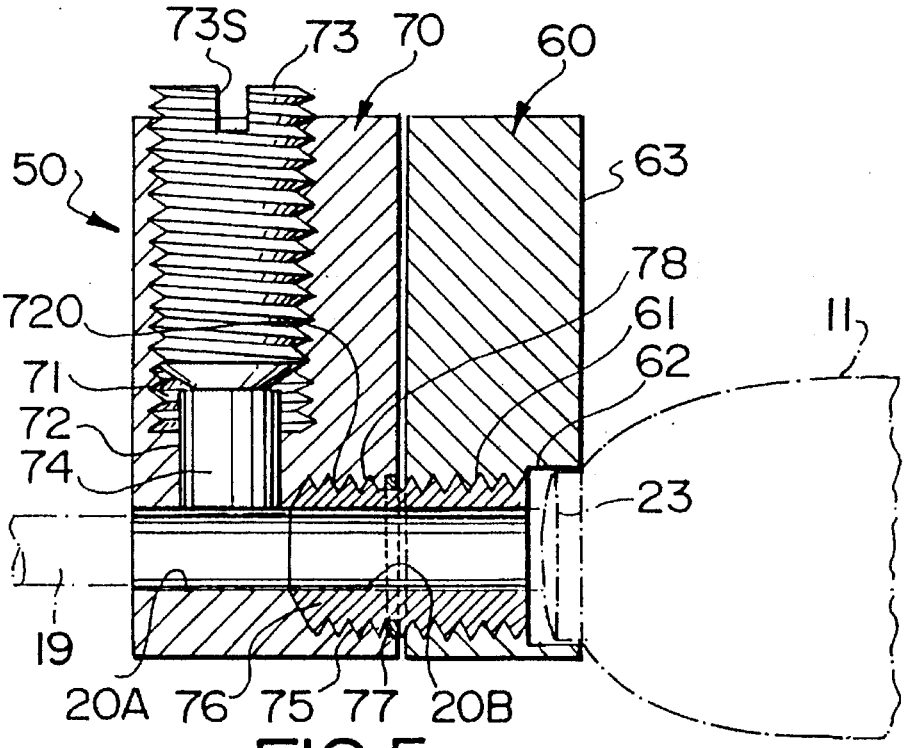
FIG. 5 is a cross sectional view of the dart point extraction tool taken at section V—V of FIG. 4.

Now referring to FIGS. 4 and 5, the extraction tool is generally shown as 50 and comprises two independent but respectively threaded blocks 60 and 70. Block 70 defines a first threaded aperture 71 with a lower stepped minor bore portion 72 that communicates with a lateral bore or aperture 20A which is sized to accommodate the shaft portion 20 of the dart 10. For convenience, a set screw or the like 73 threadingly travels in the threaded aperture 71 to urge on a metallic pressure pad, plate or block 74, which rests in the stepped minor bore 72 to urgingly bind onto the shaft portion 20 when the same is extended therethrough and the set screw 73 turned down. Co-axial, the bore 20A steps into a larger threaded portion 720 which is adapted to co-axially accommodate a threaded annular sleeve referenced 76 defining a smooth inner bore 20B sized to bore 20A both of which are larger than and accommodate shaft portion (20) so it may extend therethorugh. The threaded sleeve 76 is fixed into the block 70 by threadingly mating in the larger threaded portion 720 and cemented therein (not shown) or held by an interjoining annular retaining ring 77 frictionally and urgingly seating, on the one had, within a smaller outer annular recess defined by the threaded sleeve 75, and on the other hand, in a larger stepped bore defined at the face 78 of the block 70 and the orifice of the larger threaded portion 720. When the block 70 is turned, relative block 60, as shown in phantom in FIG. 4, and as will be more precisely described, the threaded annular sleeve 76 also rotates out of block 60

The block 60 has a threaded aperture 61 laterally extending therethrough which steps into major bore 62 whose outer diameter is sized to be slightly larger than the furrel 23 of the dart 10. The threaded bore 61 threadingly accommodates the threaded annular sleeve 75 so that it rotatingly travels therethorugh to relatively position the blocks 60 and 70 closer or further away from one another. When threadingly close as in the cross-section of FIG. 5, the dart shaft portion 20 may extend through the co-incident apertures 20A and 20B and the block face 63 of block 60 urged against the body 11 of the dart while the furrel 23 sits in the major bore 62.

By turning down the set screw 73 onto the pressure pad 74, it urges against the shaft 20 locking the dart point 14 in the block 70. By turning, counterclockwise, the block 70 relative to the block 60, the threaded annular sleeve 76 is threadingly withdrawn from block 60 pulling with it the furrel 23 and the dart point 14 from the dart body 11, in direction (S), as shown in FIG. 4, because of the urging impact of the disc plate 22 on the rear surface 26 of the furrel 23. The width of the slot 73S is sized to accommodate a coin of currency so that no screwdriver need be used. In North America the width of a dime is a sufficient slot width.

The embodiments of the invention in which an exclusive property or privilege is claimed are defined as follows:

1. A dart comprising:

(a) a cylindrical-like body defining, at one end, an aperture communicating into a tapered portion of an internal body bore, the other end of the body carrying a flight;

(b) a tapered furrel adapted to extend into the aperture and to matingly engage with the tapered portion, the furrel defining a dart point accommodating axially oriented internal furrel bore therethrough, the furrel defining an inner annular race communicating with the internal furrel bore;

(c) a dart point having a tapered shaft portion that terminates as a forward point, the tapered shaft at its opposite end stepping through an annular shoulder into a cylindrical segment defining an outer cylindrical diameter which extends to terminate at a disc plate with integral rear face whose diameter is larger than the outer cylindrical diameter;

(d) the furrel also defines an inner annular race accommodating a resilient O-ring therein whose inner diameter is less than the cylindrical diameter to frictionally engage the outer cylindrical diameter thereby holding the dart point firmly in the body but allowing the dart point to travel to and fro within the internal body bore.

2. The dart, as claimed in claim 1, wherein the distance between the integral rear face and the shoulder is dimensioned D and is approximately 20 % of the total length of the dart point.

3. In combination with the dart as claimed in claim 2, a tool for removing the dart point from the dart body including:

(1) a first block defining a threaded aperture whose inner diameter is greater than the outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends theretho-rugh.

4. The dart as claimed in claim 2, wherein the length of the internal body bore is greater than length D.

5. In combination with the dart as claimed in claim 4, a tool for removing the dart point from the dart body including:

(1) a first block defining a threaded aperture whose inner diameter is greater than the outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends therethrough.

6. The dart as claimed in claim 4, wherein the internal body bore terminates at above backwall and the inner annular race is disposed at a distance D2 from the endwall which is less than dimension D.

7. In combination with the dart as claimed in claim 6, a tool for removing the dart point from the dart body including:

(1) a first block defining a threaded aperture whose inner diameter is greater than the outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends therethrough.

8. The dart, as claimed in claim 1, wherein the outer cylindrical diameter is 3/32".

9. In combination with the dart as claimed in claim 8, a tool for removing the dart point from the dart body including:

(1) a first block defining a threaded aperture whose inner diameter is greater than the outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends therethrough.

10. The dart, as claimed in claim 1, wherein the outer diameter of the dart point end plate is smaller than the diameter of the internal body bore.

11. In combination with the dart as claimed in claim 10, a tool for removing the dart point from the dart body including:

(1) a first block defining a threaded aperture whose inner diameter is greater than the outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends therethrough.

12. In combination with the dart as claimed in claim 1, a tool for removing the dart point from the dart body including:

(1) a first block defining a threaded aperture whose inner diameter is greater than he outer cylindrical diameter;

(2) a second block defining a stepped bore, with its minor bore being sized slightly larger than the outer cylindrical diameter, the major bore carrying an annular sleeve with an inner diameter sized larger than the outer cylindrical diameter, and an outer threaded diameter sized to threadingly engage and mate into the threaded diameter of the first member and to travel therein;

(3) a second bore defined by the second block communicating with the minor bore and carrying therein means for extending into the minor bore so as to urge against the dart point when the same extends therethrough.

* * * * *